US008857357B2

(12) United States Patent
Flint et al.

(10) Patent No.: US 8,857,357 B2
(45) Date of Patent: Oct. 14, 2014

(54) METHOD OF CONTROLLING THE POSITION OF MOORED MARINE VESSELS

(75) Inventors: John Charles Flint, Warwickshire (GB); Richard Ian Stephens, Warwickshire (GB); Anthony John Howard Wilkins, Warwickshire (GB)

(73) Assignee: GE Energy Power Conversion Technology Limited, Rugby, Warwickshire (GB)

( * ) Notice: Subject to any disclaimer, the term of this patent is extended or adjusted under 35 U.S.C. 154(b) by 296 days.

(21) Appl. No.: 13/515,436

(22) PCT Filed: Dec. 14, 2010

(86) PCT No.: PCT/EP2010/007585

§ 371 (c)(1), (2), (4) Date: Sep. 17, 2012

(87) PCT Pub. No.: WO2011/072835

PCT Pub. Date: Jun. 23, 2011

(65) Prior Publication Data

US 2013/0019790 A1 Jan. 24, 2013

(30) Foreign Application Priority Data

Dec. 14, 2009 (EP) ..... 09015406

(51) Int. Cl.
*B63H 25/02* (2006.01)
*B63H 25/42* (2006.01)

(52) U.S. Cl.
CPC ..... *B63H 25/42* (2013.01)
USPC ..... 114/144 B; 318/588; 701/530

(58) Field of Classification Search
USPC ..... 114/144 B, 144 E, 144 R; 318/588, 610, 318/621; 701/21, 530
See application file for complete search history.

(56) References Cited

U.S. PATENT DOCUMENTS 3,741,474 A * 6/1973 Kawada et al. ..... 701/530
5,152,239 A 10/1992 Hossfield et al.

FOREIGN PATENT DOCUMENTS

DE 2502020 7/1975
GB 1486158 9/1977

(Continued)

OTHER PUBLICATIONS

Jenman, C., "Mixing dynamic positioning and mooring," Marine Technology Society Dynamic Positioning Conference 2005, pp. 15-16, Nov. 2005, Houston, TX, USA.
Aamo, O. M. and Fossen, T. I., "Controlling line tension in thruster assisted mooring systems," Proc. of the IEEE Int. Conf. on Control Applications (CCA '99), Hawaii, Aug. 22-26, 1999.

(Continued)

*Primary Examiner* — Lars A Olson
(74) *Attorney, Agent, or Firm* — Parks IP Law LLC; Theodore A. Wood

(57) ABSTRACT

The present invention provides a method of controlling the position of a spread moored marine vessel (1). In particular, the method of the present invention substantially maintains the position of a spread moored vessel (1) in, or on the boundary of a target area (2) using thruster assistance. This is done by monitoring the position of the vessel and when the vessel (1) is positioned outside of the target area (2) applying a position correcting thrust (7) to the vessel (1) in the direction of an aim position located on the boundary of the target area (2) and when the vessel (1) is positioned within the target area (2) reducing the position correcting thrust (7) applied to the vessel (1) or maintaining the position correcting thrust (7) applied to the vessel (1) at zero. The present invention may also apply a damping thrust (7) to the vessel (1) in order to damp the positional variation of the vessel (1). The present invention also provides a thruster assisted mooring system for a spread moored vessel (1) operating according to the method of the present invention.

14 Claims, 3 Drawing Sheets

(56) References Cited

FOREIGN PATENT DOCUMENTS

| | | |
|---|---|---|
| GB | 2204291 | 11/1988 |
| WO | WO00/34837 | 6/2000 |
| WO | WO2006/040785 | 4/2006 |

OTHER PUBLICATIONS

Berntsen, P.I.B., Aamo, O.M. and Leira, B.J., "Thruster assisted position mooring based on structural reliability," Int. Journal of Control, 81(9), pp. 1408-1416, 2008.

* cited by examiner

METHOD OF CONTROLLING THE POSITION OF MOORED MARINE VESSELS

FIELD OF THE INVENTION

The invention relates to a thruster assisted mooring system for a spread moored marine vessel. Thruster assisted mooring systems involve the controlled use of a vessel's thrusters to maintain or correct the position of the moored vessel in opposition to, or in cooperation with, external forces acting upon the vessel. External forces acting upon a moored vessel include environmental forces such as wind and current and the net anchor pattern force resulting from the, or each, anchor mooring the vessel.

The term "vessels" is intended to include ships, drilling rigs and any other surface-going vessels or platforms. The invention is principally relevant to applications in deep water but the use herein of the word "marine" is not intended to exclude its application in freshwater lakes.

BACKGROUND OF THE INVENTION

A marine vessel moves in six axes, three translational (surge, sway and heave) and three rotational (roll, pitch and yaw), see FIG. 1. A dynamic positioning system for a surface vessel usually controls only the three movements in the horizontal plane, namely surge, sway and yaw, but it may need to take into account measurements on all six axes.

The fundamental components of a general dynamic positioning system are: one or more position reference systems to measure the vessel position and heading; thrusters to apply control action; and a controller to determine the required thrusts. Typically, the object of a dynamic positioning system is not to hold a vessel absolutely stationary, but to maintain its station within acceptable limits. The magnitude of the permitted position variation is dependent upon the application and on operational concerns. In many applications a loss of position beyond the acceptable limits may have a severe impact either on the safety of personnel or equipment, or on the environment.

The present invention relates to moored marine vessels, wherein the vessels are moored by one or more anchor lines. Such vessels will have external forces acting upon them. In particular, external forces acting upon a moored vessel include the net anchor pattern force and environmental forces such as wind and current. The net anchor pattern force is the net force acting on the vessel in the surge and sway axes from the, or each, anchor line mooring the vessel. Ignoring all other external forces, the forces acting on a marine vessel from the, or each, anchor line mooring the vessel result in an anchor pattern centre where the net anchor pattern force is zero. If a moored vessel is displaced from its anchor pattern centre a net anchor pattern force will act on the vessel. The magnitude of the net anchor pattern force increases with the displacement of the vessel from the anchor pattern centre. The net anchor pattern force acts on the vessel in a direction generally towards the anchor pattern centre.

Vessels can be moored in various ways. Generally, vessels are either spread moored or turret moored.

A typical spread mooring system utilizes a set of anchor lines, normally arranged in a symmetrical pattern, attached somewhere to the vessel. This style of mooring maintains the vessel on location with a substantially fixed heading. That is, a spread moored vessel cannot rotate in the horizontal plane about its yaw axis. As a result, the connections between a spread moored vessel and the anchor lines can be relatively simple.

A turret mooring system also utilizes a set of anchor lines, normally arranged in a symmetrical pattern, attached somewhere to the vessel. However, in a turret mooring system the vessel is free to weathervane. That is, a turret moored vessel can rotate in the horizontal plane about its yaw axis into a direction where environmental loading due to wind, waves and current is minimised. This is achieved by connecting the anchor lines to a turret mounted on the vessel which, via bearings, allows the vessel to rotate independently of the anchor lines. A turret of a vessel can be mounted on the vessel either internally or externally. An external turret may be mounted, with appropriate reinforcements, on the bow or stern of the ship. If the turret is mounted internally within the vessel it may be mounted within the hull of the vessel, in a moon pool. In this case a chain table of the mooring system, which connects the anchor lines to the turret, can be either above or below the waterline.

Without thruster assistance a moored vessel will move towards or settle in a position where the net anchor pattern force acting on the vessel is equal and opposite to the net environmental force acting on the vessel. Depending upon the environmental conditions, this position may be some distance from the anchor pattern centre. If the net environmental force is large, for example during heavy weather, the vessel may move towards or settle in a position that is a significant distance from the anchor pattern centre. This can result in severe stress on some or all of the anchor lines. Furthermore, if and when the environmental conditions change and the net environmental force varies as a result, the position towards which a vessel is moving, or in which it is settled, will change. The change can be significant and may result in significant position excursions, especially during heavy weather. Such excursions are highly undesirable due to the possibility of damage to risers, entanglement with anchor lines, or excessive tension being applied to one or more anchor line. In order to minimise excursions, thruster assisted mooring systems are often used to hold a moored vessel's position substantially at a target position.

Thruster assisted mooring systems are specialised dynamic positioning systems that are used when a vessel is moored. A thruster assisted mooring system may control a vessel's movement in one or more of its surge, sway and yaw axes. Movement about or along the vessel's remaining axes is not controlled. A typical thruster assisted mooring system will attempt to maintain a vessel at or near a target position. The target position may be at a distance from the net anchor pattern centre. Thruster assisted mooring has two main purposes: i) to maintain the position of a moored vessel and thereby prevent excessive strain in the, or each, anchor line and other equipment attached to the vessel, e.g. risers which are also connected to the seabed; and ii) to reduce natural oscillations of the vessel caused by the resonance of the anchor pattern and environmental forces from waves, wind or current. The need to maintain position in the region of a riser is described, for example, in GB 1486158. The requirement to reduce natural oscillations of a vessel is stated in the standard DNV-OS-E301, Det Norska Veritas, Norway, October 2008.

The controller of a thruster assisted mooring system may take many forms. Model-based controllers have been utilised for thruster assisted mooring. However, the use of model-based controllers for thruster assisted mooring systems requires either measurement of anchor line forces, or complex models of anchor line catenaries in order to predict the anchor line forces (Jenman, C. "Mixing dynamic positioning and mooring" *Marine Technology Society Dynamic Positioning Conference* 2005, 15-16 November 2005, Houston, Tex., USA). Three-term controllers, also known as proportional-integral-differential (PID) controllers, are widely used in many applications and have been used for thruster assisted mooring. The advantage of using PID controllers for thruster assisted mooring is that they do not require anchor force measurements or a model of the anchor lines. It is also relatively straightforward to tune a PID controller for a particular system. Tuning of a PID controller for a thruster assisted mooring system may include zeroing the proportional term in the control calculation for one or more axes, this produces an integral-differential (ID) controller The controller of many known thruster assisted mooring systems acts to maintain a vessel at a target position. As set out above, this is not always necessary. In order to avoid or reduce unnecessary use of thrust, and thereby minimise energy usage, it is often preferable that a moored vessel is not held precisely at a target position but is instead maintained in an area around a target position within which the positional variations of the vessel are within acceptable limits. For example, GB1486158 discloses a thruster assisted mooring system wherein the vessel is maintained in a region surrounding a target position, rather than precisely at the target position.

For turret-moored systems, a number of specific control algorithms have been proposed for minimising energy usage of thruster-assisted mooring systems. Aamo and Fossen (Aamo, O. M. and Fossen, T. I., "Controlling line tension in thruster assisted mooring systems", *Proc. of the IEEE Int. Conf on Control Applications* (CCA '99), Hawaii, Aug. 22-26, 1999) alter the line tensions using the windlasses to obtain optimum thrust usage, while Berntsen et al (Berntsen, P. I. B., Aamo, O. M. and Leira, B. J., "Thruster assisted position mooring based on structural reliability", *Int. Journal of Control,* 81 (9), pp. 1408-1416, 2008) utilise a model of structural reliability to calculate allowable reductions in thrust. discloses the use of an ID controller on the surge axis with a target range within which the thrust demand is reduced, and outside which the thrust demand is increased. The control algorithm.

The present invention relates to spread moored vessels. Whilst, as set out above, there are many proposed control algorithms for thruster assisted mooring systems for turret-moored vessels, there are very few proposed control algorithms for thruster assisted mooring systems for spread-moored vessels. One reason for this is that the heading of turret moored vessel can be easily controlled whilst the heading of a spread moored vessel is substantially constant.

In light of the above, there is a need for a method of controlling the position of a spread moored vessel in which unnecessary use of thrust and the resulting energy usage is minimised whilst the position of the vessel is also maintained within acceptable limits without the need for anchor force measurements or models of the anchor lines. Preferably, when the forces acting on the spread moored vessel are large enough to move the vessel outside of the acceptable limits use of the method should result in the vessel being held within a position within the acceptable limits that minimises the thrust that needs to be applied to the vessel

SUMMARY OF THE INVENTION

The present invention provides a method of substantially maintaining the position of a spread moored vessel in, or on the boundary of, a target area using thruster assistance comprising:

monitoring the position of the vessel; and when the vessel is positioned outside of the target area applying a position correcting thrust to the vessel to move the vessel towards the target area; and when the vessel is positioned within the target area reducing the position correcting thrust applied to the vessel or maintaining the position correcting thrust applied to the vessel at substantially zero;

wherein the method is implemented using at least one ID control algorithm wherein the integral term of the at least one ID control algorithm is calculated towards an aim position on the boundary of the target area when the vessel is outside the target area and is decayed when the vessel is positioned within the target area.

The method of the present invention is particularly suitable for situations where holding the exact position of the spread moored vessel is not critical. This is because application of the method of the present invention to a spread moored vessel results in the vessel being held within a target area, rather than at a specific target position. Clearly, if it is necessary for a vessel to be held in an exact position, the method of the present invention is not suitable. However, in many situations, a vessel need only be maintained in an area where the stress on the, or each, anchor line is below a defined limit and/or where there is no chance of a collision with neighbouring vessels or other hazards. In these situations the present invention may be used.

When the net environmental force on a vessel is large enough to move the vessel out of the target area the method of the present invention will result in the vessel being substantially maintained on the boundary of the target area. That is, when the vessel is moved out of the target area by a net environmental force the method of the present invention will apply a position correcting thrust to the vessel to move the vessel back towards the target area. The position correcting thrust applied will be sufficient to move the vessel to the boundary of the target area. The vessel will then substantially settle at that position because the method of the present invention reduces the position correcting thrust applied to the vessel if it subsequently moves inside the target area and may increase the position correcting thrust applied to the vessel if it is subsequently moved away from the target area.

Advantageously, the method of the present invention may additionally apply a damping thrust to the vessel when the position of the vessel varies. A damping thrust may prevent the vessel undergoing large oscillations that it might otherwise undergo as a result of any variation in any other forces acting on the vessel (including the position correcting thrust).

The method of the present invention is implemented using at least one ID control algorithm. A preferred embodiment of method of the present invention is implemented using independent surge and sway ID control algorithms wherein the surge ID control algorithm determines the thrust to be applied along the vessel's surge axis and the sway ID control algorithm determines the thrust to be applied along the vessel's sway axis.

The calculation of the integral and differential terms of an ID controller according to the present invention results in a thrust reference. The thrust reference determines the direction and force that must be applied by the thrusters to the vessel at a specific time. Advantageously, thrust references are calculated at regular intervals. In a preferred embodiment of the invention thrust references are calculated at a frequency of 1 Hz.

The integral component of the thrust calculated by an ID control algorithm according to the present invention may provide the position correcting thrust whilst the differential component calculated by the ID control algorithm may provide a damping thrust.

An ID control algorithm according to the present invention may be substantially the same as an ID control algorithm according to the prior art with the exceptions of the aim position used when calculating the integral term when the vessel is located outside of the target area and the calculation of the integral term when the vessel is located within the target area.

In an ID control algorithm according to the present invention when the vessel is outside the target area the integral term of the control algorithm is calculated towards an aim position on the boundary of the target area. The aim position towards which the integral term is calculated may be a point on the boundary of the target area that is in a defined direction from an ideal target position located within the target area.

In a preferred embodiment of the present invention the aim position is based upon the direction of the position correcting thrust that was previously applied to the vessel at an immediately preceding interval. When a vessel is outside of the target area, an ID controller according to the present invention will apply a position correcting thrust to move the vessel back towards the target area. The position correcting thrust is the component of thrust resulting from the integral term of the ID control algorithm. At any given time the position correcting thrust applied to the vessel will be a vector and thus have a specific direction. This direction will be at an angle to the surge axis of the vessel. The aim position at any time at which the thrust is calculated by an ID control algorithm according to the present invention is the position on the boundary of the target area from which an ideal target position is in the same direction as the direction of the position correcting thrust that was applied to the vessel at the preceding time at which the thrust was calculated by the ID controller.

As will be understood by the person skilled in the art, the method of the preferred embodiment of the present invention achieves energy efficiency in a straightforward manner by ensuring that thrust is used to counteract effects of environmental disturbances, and does not oppose the anchor system forces.

When the vessel is inside the target area there is no aim position. Instead the integral term of the ID controller at a time at which the thrust is calculated by the ID controller is a decay of the integral term at the preceding time at which the thrust was calculated by the ID controller.

As can be appreciated, an aim position of an ID control algorithm according to the present invention may be dynamic and not fixed. In the preferred embodiment of the invention if and when the direction of position correcting thrust applied to the vessel changes then the aim position will also vary. Therefore, at any instantaneous calculation of the thrust references it is necessary for an ID control algorithm according to the present invention to first determine the aim position. This can be done in any manner that is apparent to the person skilled in the art, for example using the position reference systems of the vessel. After the aim position has been determined the position correcting thrust can be calculated by the ID controller in a conventional manner.

In order that the position correcting thrust applied to a vessel is reduced when the vessel is positioned within the target area, the integral term of an ID control algorithm according to the present invention is decayed when the vessel is positioned within the target area. This may be done in any manner apparent to the person skilled in the art. For example, when a vessel is located within the target area the integral term may be decayed by multiplying the integral term by a decaying constant at each interval at which the integral component is calculated.

The target area of the method of the present invention may be any shape. However, it may be preferable that the target area is substantially circular. The target area may or may not contain the net anchor pattern centre of the vessel. However, it may be advantageous that the target area contains the net anchor pattern centre. Furthermore, it may be preferable that the net anchor pattern centre is located substantially at the centre of the target area. In a particularly preferred embodiment of the present invention the target area is substantially circular and the net anchor pattern centre is located at the centre of the circular target area.

An ideal target position of the present invention can be at any point within the target area. However, it may be preferable that an ideal target position is at the same position as the net anchor pattern centre. Additionally or alternatively, it may also be preferable that an ideal target position is located at the centre of the target area. In a preferred embodiment of the invention the target area is substantially circular and the net anchor pattern centre and an ideal target position are located at the centre of the circular target area.

Preferably, an ID controller according to the present invention may comprise separate surge and sway controllers. The surge controller will control the magnitude of force applied by the vessel's thrusters along the vessel's surge axis at time k. This may be defined as $F_x(k)$. The sway controller will control the magnitude of force applied by the vessel's thrusters along the vessel's sway axis. This may be defined as $F_y(k)$. Both the surge and sway controllers are preferably ID controllers. The surge and sway controllers may be substantially identical. An exemplary surge controller is as follows:

$$F_x(k)=F_{ix}(k)+F_{dx}(k)$$

Where $F_{ix}(k)$ is the integral component of thrust (the position correcting thrust applied along the surge axis) at time k and $F_{dx}(k)$ is the differential component of thrust (the damping thrust applied along the surge axis) at time k.

$$F_{dx}(k)=C_d[E_x(k)-E_x(k-1)]$$

Where $C_d$ is a differential constant and $E_x(k)$ is the distance of the vessel from an ideal target position (or any other reference position) along the vessel's surge axis at time k.

$F_{ix}(k)$ is dependent on whether the vessel is inside or outside the target area. When the vessel is outside the target area:

$$F_{ix}(k)=F_x(k-1)+C_i e_x(k)$$

Where $C_i$ is an integration constant and $e_x(k)$ is the distance from an aim position on the boundary of the target area along the vessel's surge axis at time k.

When the vessel is within the target area the integral term is decayed and is:

$$F_{ix}(k)=\delta F_{ix}(k-1)$$

Where δ is a decaying constant i.e. a value less than one. For example, the decaying constant may be 0.999.

As will be appreciated, at any particular position the values of $e_x$ and $E_x$ (and $e_y$ and $E_y$) depend upon the aim position, the target area and the ideal target position (or other reference position).

As set out above, in a preferred embodiment of the invention the aim position at any time at which the thrust is calculated by the ID controller is the position on the boundary of the target area from which the target position is in the same direction as the direction of the integral component of the thrust that was applied to the vessel at the immediately preceding time at which the thrust was calculated by the ID controller. FIG. 2 shows an aim position according to the preferred embodiment of the invention, wherein the vessel (1) is located outside of a circular target area (2) and the ideal target position (3) and anchor pattern centre (4) are located at the centre of the target area (2). The integral component of the thrust (the position correcting thrust) is shown as $F_i$. The differential component of the thrust (the damping thrust) is not shown.

As can be seen in FIG. 2 the angle (θ) of the position correcting thrust relative to the surge axis of the vessel (1) is same as the angle (θ') of the direction of the ideal target position (3) from the aim position relative to an axis parallel to the surge axis of the vessel that passes through the aim position.

The method of the present invention may operate solely based upon input from position reference systems of the vessel. However, it is to be understood that the method of the present invention could also operate based upon input from the position reference systems and available estimates of the external forces acting on the vessel. For example, wind force estimates derived from wind velocity and wind direction measurements may be used in the method of the present invention.

The present invention further provides a thruster assisted mooring system for a spread moored vessel operating according to the method of the present invention. A thruster assisted mooring system will be substantially the same as a thruster assisted mooring system according to the prior art with the exception that the controller or controllers of the system according to the present invention will be programmed to operate according to the method of the present invention.

The invention can be further understood from the drawings and description below.

DRAWINGS

Figure 5:
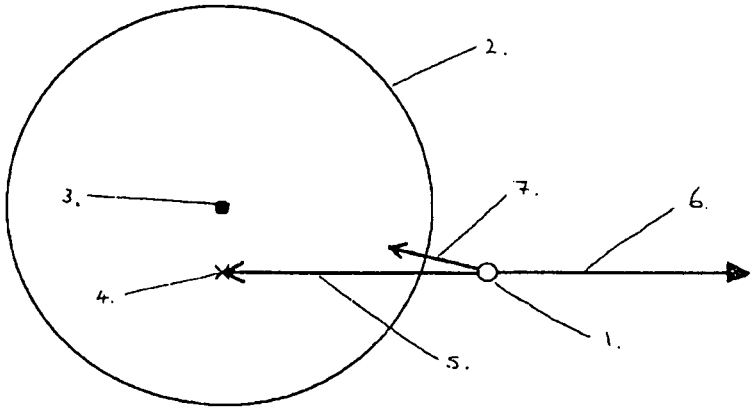
Figure 6:
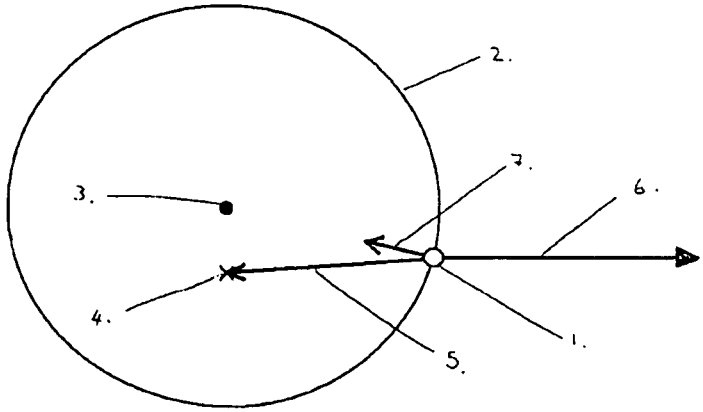

FIG. 5 is a schematic diagram of the vessel being controlled to stay in position by a controller operating according to the method of the present invention wherein the vessel is positioned in a second position outside the target area; and FIG. 6 is a schematic diagram of the vessel being controlled to stay in position by a controller operating according to the method of the present invention wherein the vessel is positioned on the boundary of the target area.

DETAILED DESCRIPTION OF EMBODIMENTS OF THE INVENTION

FIGS. 3 to 6 show a spread moored vessel 1 that is being controlled to be positioned within a target area 2 using the method of the present invention. The target area 2 is substantially circular and has an ideal target position 3 at its centre. As the vessel 1 is moored it has a net anchor pattern centre 4. If the vessel 1 were located at the net anchor pattern centre 4 the net force acting on the vessel from each anchor line along the surge and sway axes of the vessel would be zero. In the situation shown in the figures the net anchor pattern centre 4 is not at the same position as the ideal target position 3. The target area 2 is the area around the ideal target position 3 within which positional variations are of no concern.

The forces acting on the vessel 1 are schematically illustrated in the figures by arrows 5, 6, 7 wherein the direction of the arrows indicates the direction in which the force is acting and the length of the arrow is approximately proportional to the magnitude of the force. In all positions the vessel has a net anchor pattern force 5 acting on it as a result of its mooring and an environmental force 6 acting on it as a result of the environmental conditions e.g. wind and current. As will be readily appreciated, the magnitude of the net anchor pattern force 5 is substantially proportional to the displacement of the vessel 1 from the net anchor pattern centre 4 and acts in the direction of the net anchor pattern centre. In some positions a thrust 7 is applied to the vessel 1 by the vessel's thrusters. The direction and magnitude of the thrust 7 applied by the thrusters is controlled according to the method of the present invention. The thrust 7 comprises an integral, or position correcting, component and a differential, or damping, component, the sum of these components results in the total thrust 7 shown in the Figures. The controller receives information regarding the position of the vessel 1 from a suitable position referencing system.

Figure 3:
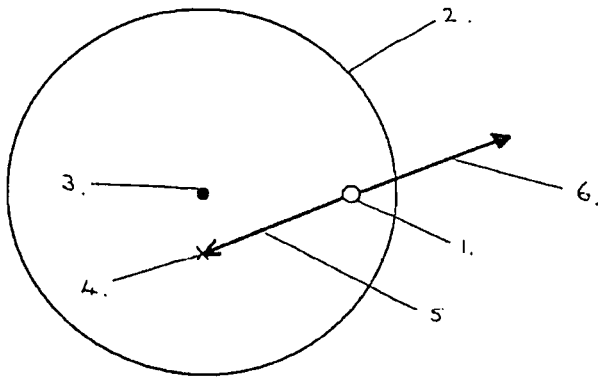
FIG. 3 is a schematic diagram of a spread moored marine vessel being controlled to stay in position by a controller operating according to a method of the present invention wherein the vessel is positioned within the target area.

In FIG. 3, the vessel 1 is positioned within the target area 2 and will be stationary as the net environmental force 6 is directly opposed to, and is the same magnitude as, the net anchor pattern force 5. Therefore, in this situation the controller is controlling the thrusters to apply substantially zero thrust to the vessel 1. In particular, zero position correcting thrust and zero damping thrust is applied to the vessel 1. If the environmental force 6 varies to move the vessel 1 within the target area 2 the controller will maintain the position correcting thrust at zero but will apply a damping thrust to the vessel 1 to damp the movement of the vessel resulting from the variation of the environmental force.

Figure 4:
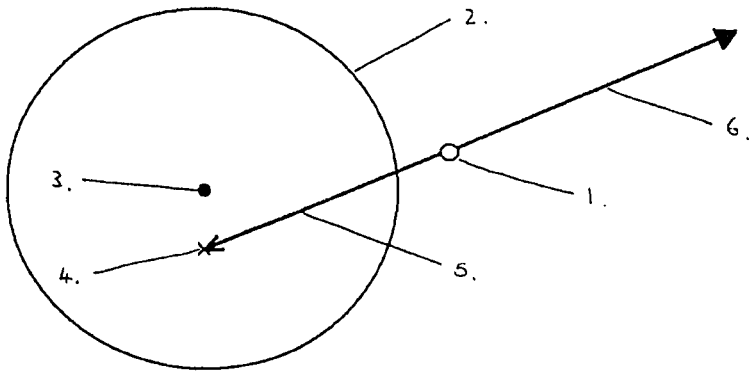
FIG. 4 is a schematic diagram of the vessel being controlled to stay in position by a controller operating according to the method of the present invention wherein the vessel is positioned in a first position outside the target area.

In FIGS. 4 and 5 the vessel 1 is positioned outside of the target area 2. This may occur if the magnitude of the environmental force 6 is sufficient to move the vessel 1 out of the target area. When the vessel 1 is positioned outside of the target area 2 the controller will control the thrusters to apply a position correcting thrust 7 in the direction of an aim position on the boundary of the target position 3 such that the vessel 1 moves back towards the target area. The controller will also control the thrusters to apply a damping component of thrust to the vessel 1 to damp the movement thereof.

In FIG. 6 the vessel 1 is positioned on the boundary of the target area 2. In this position the controller will control the thrusters to apply a position correcting thrust to the vessel 1 such that the vessel is maintained on the boundary of the target area 2. A damping thrust may also be applied to the vessel 1 in order to damp any movement of the vessel. If the environmental force is substantially constant, after a period of time the thrust 7 applied to the vessel 1 will be such that net total force acting on the vessel 1 along its surge and sway axes from the environmental force 6 the net anchor pattern force 5 and the thrust 7 applied by the controllers is substantially zero and the vessel will come to a resting position on the boundary of the target area 2.

FIGS. 3 to 6 illustrate the variation in position of a vessel 1 with a thruster assisted mooring system operating according to the method of the present invention over time.

FIG. 3 shows the vessel's initial position wherein the environmental force 6 is relatively small and substantially constant and the net anchor pattern force 5 is sufficient to maintain the vessel 1 within the target area 2. In this position there is substantially no thrust 7 applied to the vessel 1.

FIG. 4 shows the vessel's subsequent position wherein the environmental force 6 has suddenly increased and moved the vessel 1 out of the target area 2. In this position thruster assisted mooring system will control the thrusters of the vessel 1 to apply a total thrust 7 to the vessel to move the vessel back towards the target area 2. In particular, a position correcting thrust will be applied in a direction towards an aim position on the boundary of the target area. A damping thrust will be applied to the vessel 1 to damp the movement of the vessel. The total thrust 7 will be substantially as shown in the Figure. In this manner, if the environmental force 6 does not change further, the vessel 1 would be moved back to the boundary of the target area 2 by the thruster assisted mooring system.

Figure 1:
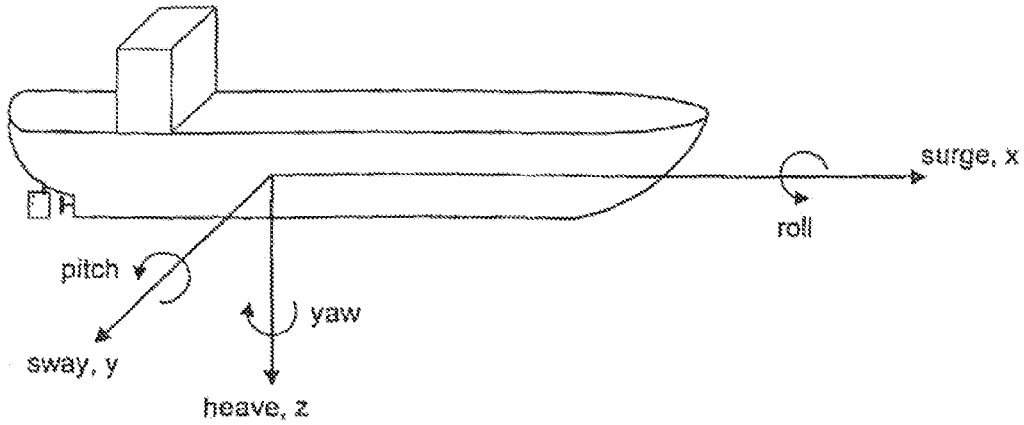
FIG. 1 is a schematic diagram of the six axes of motion of a vessel.
Figure 2:
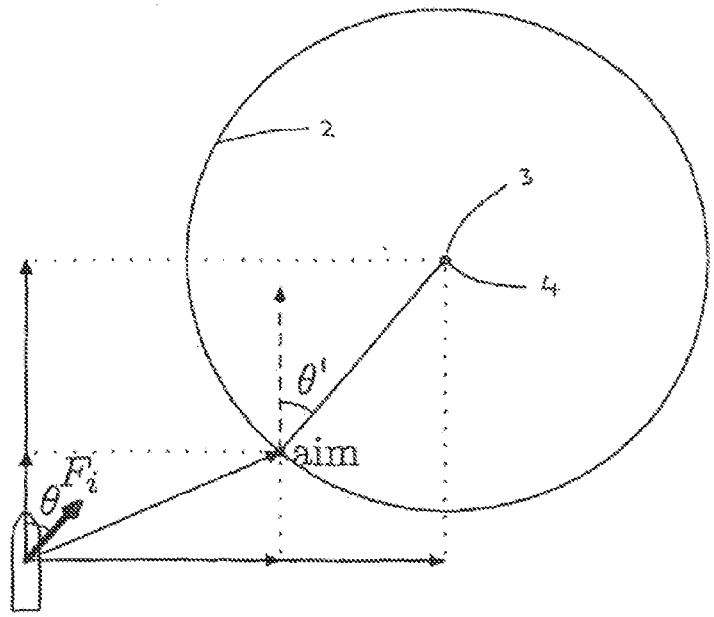
FIG. 2 is a schematic diagram of a spread moored marine vessel being controlled to stay in position by a controller operating according to a preferred embodiment of the present invention wherein the vessel is located outside of the target area.

FIG. 5 shows the vessel's position that is immediately subsequent to the position of FIG. 4 wherein the environmental force 6 has suddenly changed direction and moved the vessel 1 position relative to the target area 2 before the thruster assisted mooring system has moved the vessel back into the target area 2. In this position thruster assisted mooring system will control the thrusters of the vessel 1 to apply a total thrust 7 to the vessel that is sufficient to move the vessel back towards the target area 2. In particular, the position correcting component of thrust will be applied towards an aim position on the boundary of the target area. A damping thrust will be applied to the vessel 1 to damp the movement of the vessel. The total thrust 7 will be substantially as shown in the Figure. Importantly, the direction in which the thrust 7 will be applied to the vessel 1 has changed from the direction in which the thrust 7 was applied in the position of FIG. 2.

FIG. 6 shows the vessel's position subsequent to the position of FIG. 5. The environmental force 6 has maintained its direction and force but the action of the total thrust 7 applied by the thruster assisted mooring system has moved the vessel 1 to the boundary of the target area 2. Whilst the environmental force 6 maintains the direction and force shown in FIGS. 5 and 6 the thruster assisted mooring system will substantially maintain the vessel 1 at this point. That is, at this position the total thrust 7 applied to the vessel 1 by the thruster assisted mooring system will be in a direction towards the ideal target position 3 and will be of a magnitude such that the total net force acting on the vessel is substantially zero.

If the vessel 1 were to subsequently move inside the target area 2, for example if the magnitude of the environmental force 6 decreased slightly, then the position correcting thrust applied to the vessel 1 would gradually be reduced. Any damping thrust applied to the vessel 1 would be dependent upon the rate at which the position of the vessel 1 is varied. As the position correcting thrust is reduced the vessel 1 would move back to the boundary of the target area 2 wherein the position correcting thrust applied to the vessel 1 would be increased to be sufficient to maintain the vessel 1 on the boundary of the target area. In this manner, as long as the environmental force 6 remains sufficient to move the vessel 1 out of the target area 2 the vessel will be maintained on the boundary of the target area 2.

It is to be understood that the positional variations of the vessel 1 shown in FIGS. 3 to 6 are for illustrative purposes only. In practice, the environmental force 6 would change more gradually and a thruster assisted mooring system operating according to the method of the present invention could substantially maintain a vessel 1 on the boundary of the target area 2 or within a target area 2 in virtually all environmental conditions. In particular, the vessel 1 having a thruster assisted mooring system operating according to the method of the present invention would rarely, if ever, depart from the target area 2 by the distance shown in FIGS. 4 and 5.

The invention claimed is:

1. A method of substantially maintaining the position of a spread moored vessel in, or on the boundary of, a target area using thruster assistance comprising:

monitoring the position of the vessel and:

when the vessel is positioned outside of the target area applying a position correcting thrust to the vessel to move the vessel towards the target area; and when the vessel is positioned within the target area reducing the position correcting thrust applied to the vessel or maintaining the position correcting thrust applied to the vessel at substantially zero;

wherein the method is implemented using at least one ID control algorithm wherein the integral term of the at least one ID control algorithm is calculated towards an aim position on the boundary of the target area when the vessel is outside the target area and is decayed when the vessel is positioned within the target area.

2. A method according to claim 1, wherein when the vessel is outside the target area the integral term of the at least one ID control algorithm is calculated towards an aim position on the boundary of the target area where the boundary of the target area intersects a straight line from an ideal target position, which is located within the target area, to the vessel.

3. A method according to claim 1, wherein when the vessel is outside the target area the integral term of the at least one ID control algorithm is calculated towards an aim position on the boundary of the target area from which an ideal target position, which is located within the target area, is in the same direction as the position correcting thrust that was applied to the vessel at an immediately preceding time at which the integral term was calculated by the at least one ID control algorithm.

4. A method according to claim 2, wherein the ideal target position is located at the center of the target area.

5. A method according to claim 1, wherein the target area is substantially circular.

6. A method according to claim 1, wherein the target area includes a net anchor pattern center of the vessel.

7. A method according to claim 1, wherein the position of the vessel is monitored and controlled with respect to the vessel's surge and sway axes.

8. A method according to claim 7, wherein the method is implemented using independent surge and sway ID control algorithms.

9. A method according to claim 1, wherein a damping thrust is applied to the vessel when the position of the vessel varies.

10. A method according to claim 9, wherein the total instantaneous thrust applied to the vessel is a sum of the position correcting thrust and a damping thrust.

11. A method according to claim 9, wherein the integral term of the at least one ID control algorithm provides a position correcting thrust and the differential term of the at least one control algorithm provides a damping thrust.

12. A thruster assisted mooring system for a spread moored vessel the system operating according to a method comprising:

monitoring the position of the vessel and:

when the vessel is positioned outside of a target area applying a position correcting thrust to the vessel to move the vessel towards the target area; and when the vessel is positioned within the target area reducing the position correcting thrust applied to the vessel or maintaining the position correcting thrust applied to the vessel at substantially zero;

wherein the method is implemented using at least one ID control algorithm wherein the integral term of the at least one ID control algorithm is calculated towards an aim position on a boundary of the target area when the vessel is outside the target area and is decayed when the vessel is positioned within the target area.

13. A method according to claim 3, wherein the ideal target position is located at the center of the target area.

14. A method according to claim 10, wherein the integral term of the at least one ID control algorithm provides a position correcting thrust and the differential term of the at least one control algorithm provides a damping thrust.

* * * * *